United States Patent [19]

Sakamoto

[11] 4,103,416

[45] Aug. 1, 1978

[54] METHOD OF MANUFACTURING AN HERMATICALLY SEALED ELECTRICAL TERMINAL

[75] Inventor: Yoshimasa Sakamoto, Otsu, Japan

[73] Assignee: New Nippon Electric Co., Ltd., Osaka, Japan

[21] Appl. No.: 733,013

[22] Filed: Oct. 15, 1976

[30] Foreign Application Priority Data

Oct. 21, 1975 [JP] Japan ..... 50/127247

[51] Int. Cl.[2] ..... H01B 17/26

[52] U.S. Cl. ..... 29/630 D; 29/424; 65/43; 65/59 R; 65/59 B; 174/152 GM; 339/278 C

[58] Field of Search ..... 29/630 D, 630 B, 630 R, 29/424; 65/43, 59 R, 59 B; 174/50.61, 152 GM; 339/278 C, 278 D

[56] References Cited

U.S. PATENT DOCUMENTS

| | | | |
|---|---|---|---|
| 2,284,151 | 5/1942 | Kingston | 339/278 C X |
| 2,446,277 | 8/1948 | Gordon | 174/50.61 X |
| 3,141,753 | 7/1964 | Certa | 65/59 B X |
| 3,199,967 | 8/1965 | Pixley | 65/59 B X |
| 3,637,917 | 1/1972 | Oates | 174/152 GM |

*Primary Examiner*—Carl E. Hall

*Attorney, Agent, or Firm*—W. G. Fasse; W. W. Roberts

[57] ABSTRACT

An electrical terminal device comprises a metallic body or support cut through which an iron-chronmium alloy, conductive lead wire extends in an insulated and sealed manner. The free ends of the lead wire or wires extend out of the cup. A glass-to-metal seal is provided between the wires and the cup. The free ends of the lead wires are partially plated or coated with a layer of an oxidation resistant metal. A portion intermediate the free ends is provided with a layer of chromium oxide to improve the seal between the lead wire and a fused glass bead held in an aperture in said support cup. The method of manufacturing such devices comprises partially plating a nickel, copper or other metal which is resistant to oxidation in a hydrogen atmosphere at high temperature and humidity, on the surface of the terminal end portions of the lead wires, while the intermediate portion where the conductor is secured to a glass bead is left free of such a plating. The intermediate portion is then oxidized to provide a chromium oxide layer on the intermediate portion of the lead wire by a selective oxidation of the chromium component. A hermetic seal is then provided between the intermediate portion or rather the chromium oxide layer of the intermediate portion and a glass bead as well as between the glass bead and the cup. The oxide layers on the exposed surfaces of the support cup and on the lead wire, if any, are then removed in a reducing atmosphere.

5 Claims, 3 Drawing Figures

METHOD OF MANUFACTURING AN HERMATICALLY SEALED ELECTRICAL TERMINAL

BACkGROUND OF THE INVENTION

This invention relates to a hermetically sealed electrical terminal device, and to a method of manufacturing such terminal devices. These devices are used to provide electrical lead-in connections hermetically sealed containers or the like. The electrical connections may include one or more conductive lead-in wires of iron-chromium alloy each having an intermediate portion which projects through and is secured in an insulator bead which in turn is sealed into a metallic body or support cup. The bead of insulating material may be, for example, glass to provide a glass-to-metal seal and the terminal or free ends of the lead-in wires are disposed on opposite sides of the seal.

Generally, the motor of a compressor unit used in refrigerators and air conditioners is supported in a closed housing containing a cooling medium and an insulating oil. For supplying electrical power to such a motor, a hermetically sealed electrical terminal device which maintains an air tight seal and electrical insulation of the closed housing has been used. The conventional terminal device having conductive lead-in wires and a support cup or socket, has employed a glass-to-metal seal to bond the lead-in wire to the cup or socket. Such terminal devices for a compressor are inserted from the inside through a window hole provided in a side wall of the otherwise closeable housing of the compressor. The socket is welded in place to seal the housing air tight. Then, the inner terminal of the lead conductor of the device is connected with the input lead wire of the compressor motor disposed in the closeable housing and the outer terminal of the lead wire is connected with an electric power source. If necessary, two iron terminal plates or connectors of appropriate configuration are previously secured at both ends of the lead wire or wires to facilitate the connection to the motor and/or to the power supply.

In the conventional method of manufacturing a hermetically sealed electrical terminal device as described above, the metallic cup or socket and the leads which are components of the electrical terminal device, are first cleaned and oxidized to prepare oxide film layers on the entire surface thereof. Meanwhile, glass tablets for effecting the connection of the leads in the cup are prepared by mixing a fine powder of glass with an organic binder, press-moulding the resultant mixture into cylindrical tablets and baking the tablets until the organic binder is completely removed by burning or vaporization. Thereafter, the metallic cup or socket and the leads, each having a metallic oxide surface layer as mentioned above, are assembled with the galss tablets into proper positions relative to each other. The assembly is heated in a neutral or reducing atmosphere to melt the glass tablets or beads and to hermetically seal the metallic socket and the leads with the fused glass. After cooling, the oxide film layers on the exposed surfaces of the assembly, that is, on the surfaces not covered with the fused glass, are removed and thus, an air tight, hermetically sealed terminal device is completed.

The material of the leads is conventionally an iron-chromium alloy, for example, No. 446 alloy which has a chromium content of 25 - 28% by weight. This alloy has the mechanical properties desired for the electrical terminal device. A selective oxidation of the chromium may be achieved on the iron-chromium alloy. The selective oxidation of chromium can be carried out utilizing the fact that the partial pressure of oxygen gas in a gaseous phase which results in the chromium (III) oxide is different from the equilibrium pressures of oxygen of oxides of other metals contained in the alloy. That is, by adjusting the partial pressure of oxygen in a hydrogen atmosphere at high temperature, e.g., by adjusting the water vapor in the hydrogen atmosphere so as to make the partial pressure higher than the equilibrium oxygen pressure of the chromium oxide, the selective oxidation of chromium may be carried out. For example, when the iron-chromium alloy is contacted by a hydrogen atmosphere whose dew point is adjusted to 50° C, for example by passing the hydrogen atmosphere through a humidifier containing water retained at the dew point; the chromium is selectively oxidized at about 1000° C.

Since the oxide film layer of chromium obtained by the selective oxidation of chromium adheres to the iron-chromium alloy much more strongly than does an oxide film layer of iron, e.g. $Fe_3O_4$ and adheres strongly to the glass for sealing, it becomes possible to obtain a superior seal and this is an important advantage in the conventional method explained above. However, since the chromium oxide also adheres very strongly to all surfaces of the leads, even after the sealing procedure, the elimination of the chromium oxide on the terminal portions of the lead-in wire or lead conductor becomes necessary and is rather trouble-some though it is, of course, possible to remove said oxide mechanically or chemically.

Ordinarily, a mechanical method of removing the chromium oxide film from the free ends of the lead-in wires is used, for example, polishing in a tumbling drum. A chemical removal method further oxidizes the $Cr^{III}$-oxide on the terminal portions to form the $Cr^{VI}$-oxide by using an oxidizing agent such as potassium permanganate.

The $Cr^{VI}$-oxide is then washed off in an acid washing process by dipping $Cr^{VI}$-oxide coated free ends of the lead wires into a sulphuric acid bath and into a hydrochloric acid bath. However, any one of these methods of elimination of the $Cr^{III}$-oxide layer on the exposed surfaces of the terminal or free ends of the lead-in wires is disadvantageous since not only is the method itself rather tedious, demanding a larger amount of work, but also undesirable cracks in the sealing glass can be produced by applying a mechanical treatment. Besides, the chemical treatments always require a subsequent waste water treatment, which adds to the cost of manufacture. Therefore, it has long been desired to find an improved method of manufacturing such terminal devices in which it is possible to seal the iron-chromium alloy lead-in wires strongly and hermetically to the glass bead and the latter to the socket. It is also desirable to easily remove the oxidized film layers on the exposed surfaces after the assembly is completed.

OBJECTS OF THE INVENTION

In view of the foregoing, it is the aim of the invention to achieve the following objects singly or in combination:

to provide a new and improved method of manufacturing hermetically sealed electrical terminal device having conductor leads or lead-in wires of iron-chromium alloy, on each of which a selectively oxidized chromium layer is formed only on the intermediate portion and not formed on the terminal portion or free ends of the lead-in wires;

to provide a new and improved electrical terminal device manufactured by assembling a metallic body, socket, or cup and conductor leads and glass tablets, heating them for sealing the leads into the socket and descaling the surfaces of the assembled device, wherein each lead-in wire is prepared by a simple treatment and can easily be descaled after assembly; and to provide an electrical terminal device having at least one conductor lead or lead-in wire of iron-chromium hermetically and rigidly sealed to a metallic socket with a glass-to-metal seal, and provided with a selective chromium oxide layer on the intermediate portion thereof.

SUMMARY OF THE INVENTION

These and other objects, advantages and features are attained in accordance with the invention by manufacturing a hermetically sealed electrical terminal device with one or more lead-in wires of an iron-chromium alloy cut from a respective conductor to a predetermined length, coating an intermediate portion of the lead-in wire with a plating resist material, plating a metal which prevents formation of a selective chromium oxide layer on the terminal or free end portions of the lead-in wire to form a partial coating thereon, removing the plating resist layer by the use of an appropriate organic solvent to expose a free surface on an intermediate portion between said free ends and forming by a selective oxidation process a chromium oxide layer on the oxide free surface of the intermediate portion.

The conductor leads prepared by the above steps are assembled with a metallic cup or socket or support structure and a glass tablet prepared individually in a conventional manner. The assembly is then heated to fuse the glass tablet and hermetically seal the conductor leads to the glass tablet or bead and the latter to the socket by means of glass-to-metal seals. The hermetically sealed electrical terminal device is finished by descaling and removing undesired oxide layers which may form on the exposed surfaces of the socket and the lead conductor or conductors.

According to another aspect of the invention an electrical terminal device comprising a metallic socket, at least one lead conductor of iron-chromium alloy and glass-to-metal seals, is manufactured by preparing a lead conductor having intermediate and terminal end portions, coating the intermediate portions with a plating resist material, partially plating or coating the terminal or free end portions, removing the resist material from the intermediate portion and forming by selective oxidation an oxide layer on said intermediate portion, preparing a metallic socket or cup having at least one aperture by forming, e.g. deep drawing or punching, annealing and oxidizing an iron sheet metal, preparing a glass tablet or bead by mixing glass powder with binder, forming and baking the glass bead to remove the organic contents and to sinter the glass, assembling the prepared conductor lead, socket and glass tablet in a mounting jig, sealing the intermediate portion of the conductor lead to the bead in the aperture of the socket and the latter to the glass bead with a glass-to-metal seal, and thereafter descaling to remove oxide layers on the surfaces of the exposed metallic socket and lead-in conductor.

BRIEF FIGURE DESCRIPTION

In order that the invention may be clearly understood, it will now be described, by way of example, with reference to the accompanying drawings, wherein.

Figure 1:
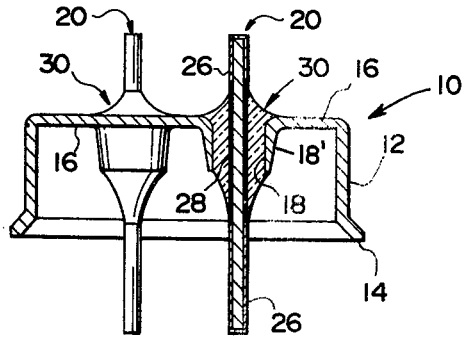
FIG. 1 is a vertical sectional view of a hermetically sealed electrical terminal device of the present invention.

DETAILED DESCRIPTION OF PREFERRED EXAMPLE EMBODIMENTS:

FIG. 1 shows a vertical sectional view through a hermetically sealed terminal device produced by the method of the present invention. The device comprises a metallic socket or cup 10 which is made of iron sheet metal to have a ring-shaped side wall 12 provided with a flange 14 and a bottom 16. The bottom 16 has a plurality of holes or apertures 18 surrounded by collars 18' for receiving lead-in wires 20, there being three such apertures and leads in this embodiment, for example. Each lead-in wire 20 is hermetically and rigidly sealed in an associated aperture 18 by a glass bead 30 forming a glass-to-metal seal of fused glass.

The socket 10 is made, for example, by press forming or die punching from iron sheet metal and cleaned with an organic solvent such as trichloroethylene (CHCL : $CCl_2$) or tetrachloroethylene ($Cl_2C$ : $CCl_2$) in order to remove lubricants and other organic substances adhering to its surface. After cleaning the socket 10 is annealed at a high temperature under a hydrogen gas stream to clean its surface and to reduce the carbon content as a necessary preparation for the next step. The so prepared socket 10 is then heated to 600°–700° C in an oxidizing atmosphere in an oven to produce an oxide film layer on the surface of it. FIG, 2 shows the just mentioned steps for the preparation of the socket 10, and also the other steps here involved.

Figure 3:
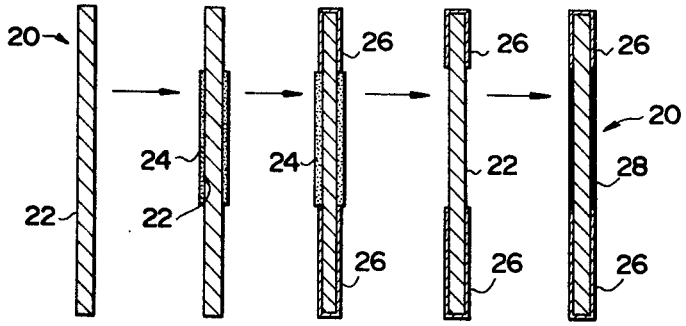
FIG. 3 comprises several vertical sectional views of a conductive lead used for the terminal device of the present invention and showing a series of successive steps in treating the lead-in wire or conductor.

In the meanwhile, the conductive lead-in wires 20 are treated in various steps as shown in FIGS. 1 and 3. First, a wire of iron-chromium alloy is cut to a desired length to form the lead-in wire 20 which is then partly covered on a portion 22 intermediate its ends with a resist layer 24 of a material preventing plating comprising a synthetic resin, for example, manufactured by Toka Shikiso Kagahu-Kogyo Company in Japan and merchandized under the trademark BON MARQUE. It is noted, that the resist layer should be selected from materials which are acid-proof, alkali-proof, and which assure an intimate bond between the resist layer 24 and the iron-chromium alloy wire 20. The resist material 24 must also be soluble in an organic solvent so that the resist 24 may be easily removed prior to the selective oxidation at 28.

As the next step, the free end of the lead-in wires are provided with layers 26 formed, for example, by electro-plating the bare surfaces of the terminal end portions of the lead-in wires 20. In other words, on the portions of the lead-in wires 20 where the resist layer 24 for preventing plating is not provided, a partial plating is carried out by dipping the lead conductor 20 completely into a plating liquor of nickel or copper or other metal. The thickness of the plating layer 26 is between 8 and 20 microns, preferably about 10 microns, to prevent diffusion of chromium during the next selective oxidation and sealing steps. Further, the plating layer 26 has a higher melting point to withstand the successive heat treatment steps.

Figure 2:
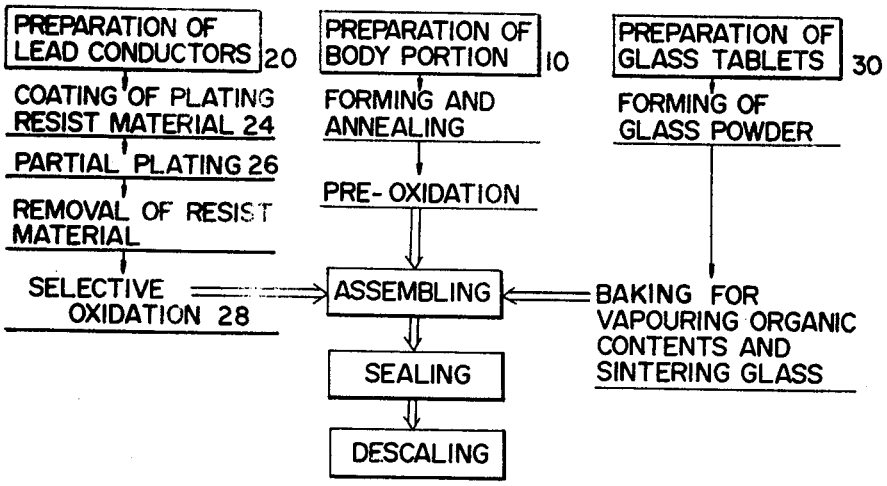
FIG. 2 shows a block diagram showing each step in the manufacturing of the terminal device of the present invention.

After the plating, the resist layer 24 is removed by an appropriate organic solvent to expose a free surface on the intermediate portion 22 where the glass-to-metal sealing is to be carried out as shown in FIG. 2, and a selective oxidation of the chromium component at the intermediate portion is carried out. The selective oxidation step is carried out as a treatment of the lead conductor 20 at about 950° C temperature for 30 minutes, in a hydrogen atmosphere containing an appropriate amount of water vapor such as a 50° C dew point, wherein the selective oxidation does not occur on plating layer 26 of the terminal portions.

As a result of tha above described steps, the lead-in wire or conductor 20 has an oxide film 28 of chromium on the surface of its intermediate portion 22 where a glass-to-metal seal will be provided by a glass tablet 30 or bead. The wire 20 further has a metallic plating 26 on the surface of its terminal or end portions.

In the meantime, glass tablets are formed as shown in FIG. 2. That is, for example, a fine powder of glass is prepared by pulverizing a soda barium glass so as to make it pass completely through a 150 mesh sieve and one half of it passes through a 350 mesh sieve. The glass powder is mixed with an organic binder such as carbowax. The mixture is moulded into cylindrical tablets or beads, each having a desired volume, using a press tabletting machine and then, in the next step, the tablets are baked, for example, at 500° C to remove the organic binder completely and sequently at 750°0 C to sinter the glass powder.

Next, the socket 10 and a number of lead-in wires 20 together with the glass tablets, which are prepared as mentioned above, are assembled in a graphite tool jig and the assembly is heated to 980°- 1020° C in a weakly reducing atmosphere for about 12 minutes to fuse the glass tablets and hermetically seal the leads 20 in the aperture 18 of the socket 10. After the sealing step, the assembly is removed from the sintering oven, cooled and finally, the terminal device is dipped in a weak acid solution whose acidity is such that it will eliminate the oxide film layer on the socket 10 and from the portions of the leads projecting from the glass seal 30. For example, a 10 - 20% hydrochloric acid solution is suitable for this purpose. This procedure is called descaling.

In the hermetically sealed terminal device obtained by the above method of the present invention, each bare terminal portion of the lead-in wires 20 is substantially covered with the metallic plating layer 26. If desired, and in order to still further improve the protection of the terminal device from erosion by oxidation another plating layer may be applied to the device thus the terminal or end portions of each lead-in wire would have two plating layers.

It is an important advantage of the present invention that the bond between the glass bead 30 and the chromium oxide film in the intermediate portion 22 is especially strong mechanically as well as in a sealing sense because a reliable air tight seal is also achieved according to the invention. Moreover, since the chromium oxide layer, which has a tendency to adhere strongly with the glass, does not appear on the portions of the lead-in wires other than the intermediate portion 22 which is bonded to the glass seal, it becomes possible to employ mechanized production lines for entire steps including discaling. Oxide film layer of plating material on each terminal portion of the lead-in-wire can be removed as well as the oxide film on the socket 10 easily with a weak acid solution.

Yet another advantage of the invention is seen in that it is now unnecessary to mechanically polish the finished product. A complicated chemical treatment for the removal of the chromium oxide film layer as in the conventional method of producing an air tight terminal device, has also been obviated, whereby the production costs are still further reduced. The present process is simple and the consumption of materials has been reduced and the waste water treatment is very much simplified.

Although the invention has been described with reference to a terminal device for a compressor, it will be recognized that the devices and the method of production are also useful for other applications, such as in non-magnetic terminals, and terminals for general purposes, for example, in gas discharge lamp terminals. Therefore, it will be appreciated, that it is intended to cover all modifications and equivalents within the scope of the appended claims.

What is claimed is

1. A method of making an electrical terminal device, comprising covering the free ends of an iron-chromium alloy lead wire with a layer of oxidation resistant metal, coating an intermediate length of said lead wire between said free ends with a resist material to prevent the covering of said length by said oxidation resistant metal, when the latter is applied to cover said free ends, removing said resist material, then oxidizing said intermediate length of said lead wire between said free ends to provide a chromium oxide layer intermediate said free ends, thereafter securing, in an insulated and sealed manner, said lead wire to a support cup means at said intermediate length having said chromium oxide layer thereon, said oxidizing taking place in a selective oxidation process to produce said chromium oxide layer.

2. The method of claim 1, wherein said selective oxidation process is performed by heating the lead wire to about 950° C for approximately 30 minutes in a hydrogen atmosphere containing water vapor.

3. The method of claim 1, wherein said lead wire is secured to said support cup by assembling the lead wire, support cup and a glass tablet in a holder jig, and heating the assembly at about 1000° C in a reducing atmosphere to fuse the glass around said lead wire and to said support cup.

4. The method of claim 1, wherein said layer of oxidation resistant metal has a thickness sufficient to prevent the formation of chromium oxide thereon during said selective oxidation process.

5. The method of claim 4, wherein said layer of oxidation resistant metal has a thickness of about 8 to 20 microns.

* * * * *